US005143762A

United States Patent [19]

Ho

[11] Patent Number: 5,143,762

[45] Date of Patent: Sep. 1, 1992

[54] INNOVATED LIMB COVERING

[76] Inventor: Jung H. Ho, No. 16, Lane 69, Hsueh Fu Rd., Taichung, Taiwan

[21] Appl. No.: 641,587

[22] Filed: Jan. 15, 1991

[51] Int. Cl.[5] ..... A41D 13/00; B65D 65/00

[52] U.S. Cl. ..... 428/35.7; 428/36.8; 2/16; 2/22; 2/159; 2/168; 2/DIG. 5; 128/846

[58] Field of Search ..... 428/36.8, 35.7; 128/82, 128/157, 846, 882; 2/DIG. 5, 22, 16, 59, 159, 168

[56] References Cited

U.S. PATENT DOCUMENTS

| | | | |
|---|---|---|---|
| 713,239 | 11/1902 | Peterson | 2/59 |
| 2,326,422 | 5/1942 | Weisberger | 2/59 |
| 3,659,599 | 5/1972 | McLaughlin | 128/157 |
| 4,562,834 | 1/1986 | Bates | 128/157 |
| 5,010,597 | 4/1991 | Glover | 2/22 |
| 5,016,648 | 5/1991 | Brown | 128/846 |

*Primary Examiner*—Ellis P. Robinson
*Assistant Examiner*—Rena L. Dye
*Attorney, Agent, or Firm*—Sughrue, Mion, Zinn, Macpeak & Seas

[57] ABSTRACT

This invention is to provide the innovated limb covering which will improve on some drawbacks of the conventional protective sleeve, long glove, and galoshes, for people having such dress, the access of these conventional limb coverings is too small to be worn, and great inconvenience will be encountered in working even though these coverings can be worn hard. For people dressing little, these limb coverings seem to be loose and may cause failure in use. The innovated limb covering, which comes up without forgoing shortcomings, made of rubber or plastic material by one-piece forming process, comprises the elastic band at one end for easy wearing and close holding; at opposite end it also has several predetermined number of elastic binders whose radius become smaller as getting close to the end for tightly fitting limb and dress; between these two ends the oval-shaped tube with longitudinal fold all over itself is taken as main elastic limb covering body for accommodating limb and clothes properly.

4 Claims, 6 Drawing Sheets

INNOVATED LIMB COVERING

BACKGROUND OF THE INVENTION

The present invention is directed to a limb covering and more particularly to a limb covering adapted to cover the forearm or lower leg of a user, either alone or in combination with a glove or a boot.

Conventional limb coverings have been widely used in the form of a protective sleeve which is worn by a cashier or accounting people. Elongated gloves comprised of a glove having an extended limb covering have been used by housewives, garage repair men, construction workers, crews of fishing boats, chemical handlers, physicians and other people desiring such protection. High boots having elongated limb covering in combination with the boot portion have been utilized by residents in frigid zones and by people wishing to walk in muddy areas. Such limb coverings can protect clothing from pollution, prevent injuries to the human body from chemicals, isolate people from contact with germs and viruses and can also be used to provide waterproofing and chill protection. However, such limb coverings have presented unavoidable defects since people usually wear heavier clothing when the weather is chilly and the configuration of the prior art limb coverings cause people to feel uncomfortable and cause inconveniences in working, even though such coverings can be worn hard. On the other hand, people dress very lightly when the weather is hot and such prior art limb coverings tend to be loose and may result in slipping and failure in use. The common foot covering is either galoshes or rainshoes. Short galoshes having a height below the knee may not effectively prevent mud, snow and water from entering into the galoshes, while longer galoshes or rainshoes having a height adjacent or above the knee may easily slip and move with difficulty in mud due to the heavier weight and no means for securing the upper end.

SUMMARY OF THE INVENTION

Thus, the primary object of the present invention is to provide a limb covering which is easily worn while providing a close tight fit with sufficient comfort under all circumstances.

Another primary object of the present invention is to provide an elongated limb covering made of rubber or plastic material having longitudinal folds or creases extending substantially the length of the limb covering and repeated about the entire circumference thereof so that it can be used on limbs of any dimension and by people in any state of dress while still providing convenience and nimbleness in the movements of the wearer.

Still another object of the present invention is to provide a limb covering having an elastic band at one end and several consecutive elastic binders at the opposite end with each of the binders having a different radius with each radius decreasing in size toward the end of the limb covering and an elastic covering body which are manufactured by a one piece forming process. One or more elastic binders can be cut from the limb covering depending upon the limb dimensions and the amount of clothing worn by the user so that the limb covering will have a close, tight fit under all circumstances.

A final object of the present invention is to provide a new and improved limb covering which can be used in combination with galoshes with the upper end fixed securely adjacent the user's knee and firmly attached adjacent the ankle through an elastic band. The limb covering is fitted for any dimension of shoes, legs or clothing without discomfort while preventing slipping and undesired pollution on shoes and reducing the cost due to the elimination of the need for special thicker materials in the manufacturing process.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
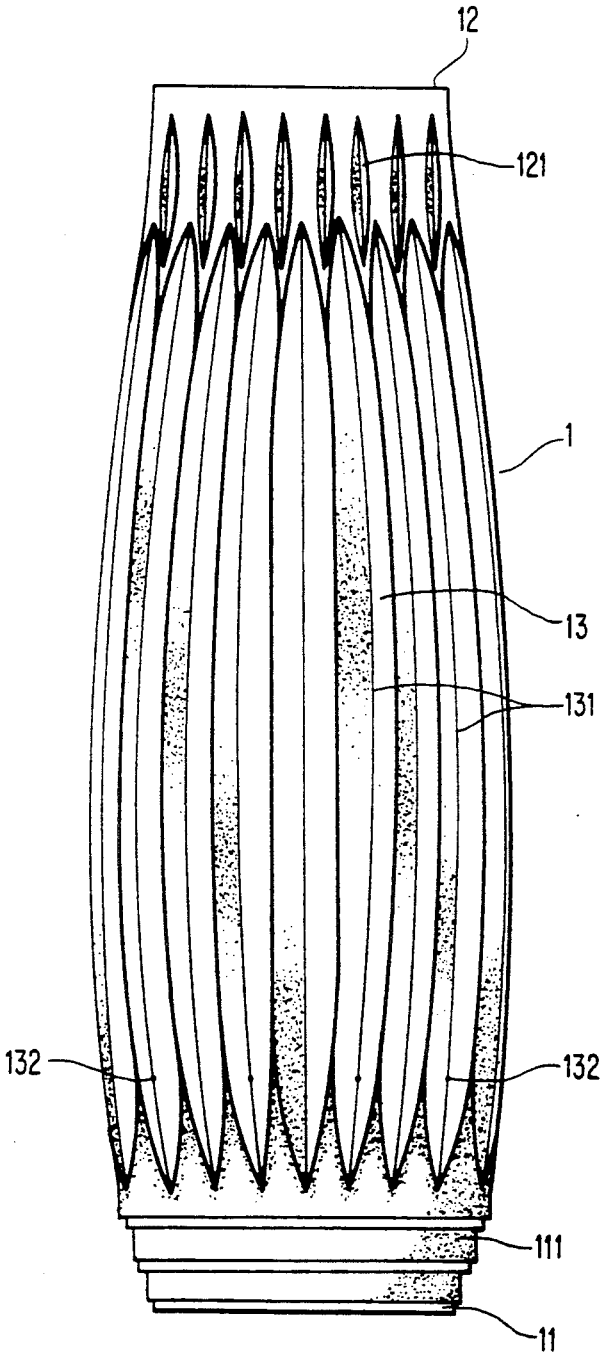
FIG. 1 is a plan view of a limb covering according to the present invention with the longitudinal folds in a substantially relaxed condition.

As shown in FIG. 1, the limb covering 1 is used as a protective sleeve and is comprised of rubber or plastic material formed through a one piece forming process. The protective sleeve includes a first end 11, a second end 12 and a main body covering 13 with folds or creases 131 extending substantially the entire length of the protective sleeve about the entire circumference thereof. The second end 12 has a single elastic band 121 for firmly engaging the limb of a wearer adjacent the wrist or ankle. The first end 11 includes a plurality of elastic binders disposed adjacent each other. Each of the binders 11 has a different radius which is the radius of consecutive binders decreasing toward the end of the sleeve so that one or more of the binders 111 can be cut off according to the size of a user's limb or the amount of clothing worn on the limb in order to obtain a close, tight fit adjacent the elbow or knee of a wearer. The main covering body 13 between the elastic binders 111 and the elastic band 121, is comprised of an oval-shaped tube of elastic material having a plurality of longitudinal folds 131 extending about the entire circumference of the sleeve. Several small convex points or projections 132 are formed in the folds adjacent the top end of the folds 131 of the main covering body 13. The preferred number of convex points 132 ranges from 2 to 4. The points can be cut off to provide small air exhaust holes which are small enough to prevent the penetration of water into the interior of the main covering body 13.

Figure 2:
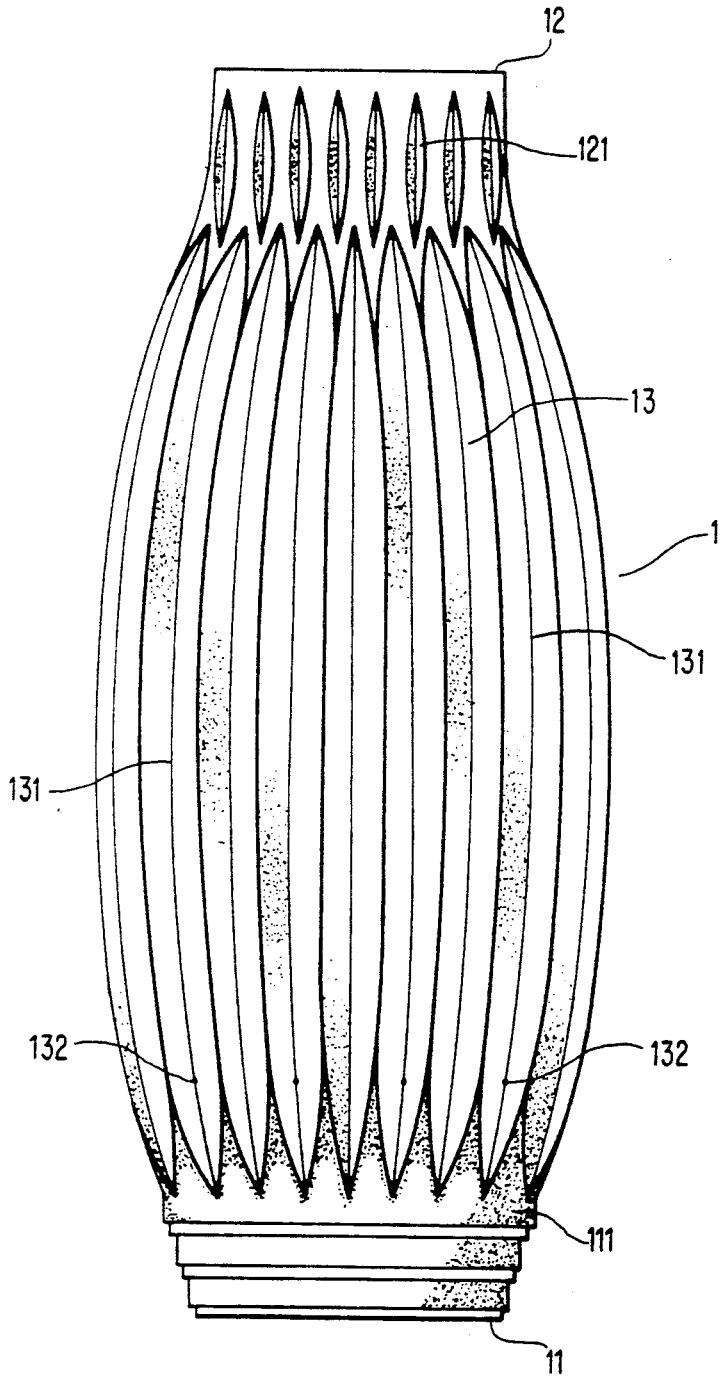
FIG. 2 is a plan view of the limb covering according to the present invention with the longitudinal folds in a substantially expanded condition for fitting over heavy clothing.

The limb covering as shown in FIG. 2 is in the expanded condition to compensate for a heavily dressed condition such as would occur in winter. The limb covering 1 can be put on very easily by inserting the arm or leg into the end 11 and out the end 12 without difficulty since the main covering body 13 can be properly expanded to accommodate any large dimensions of a limb or clothing thereon. Air exhaust outlets can be made available if necessary and the arm or leg equipped with the limb covering 1 can freely move in a comfortable and effective manner.

Figure 3:
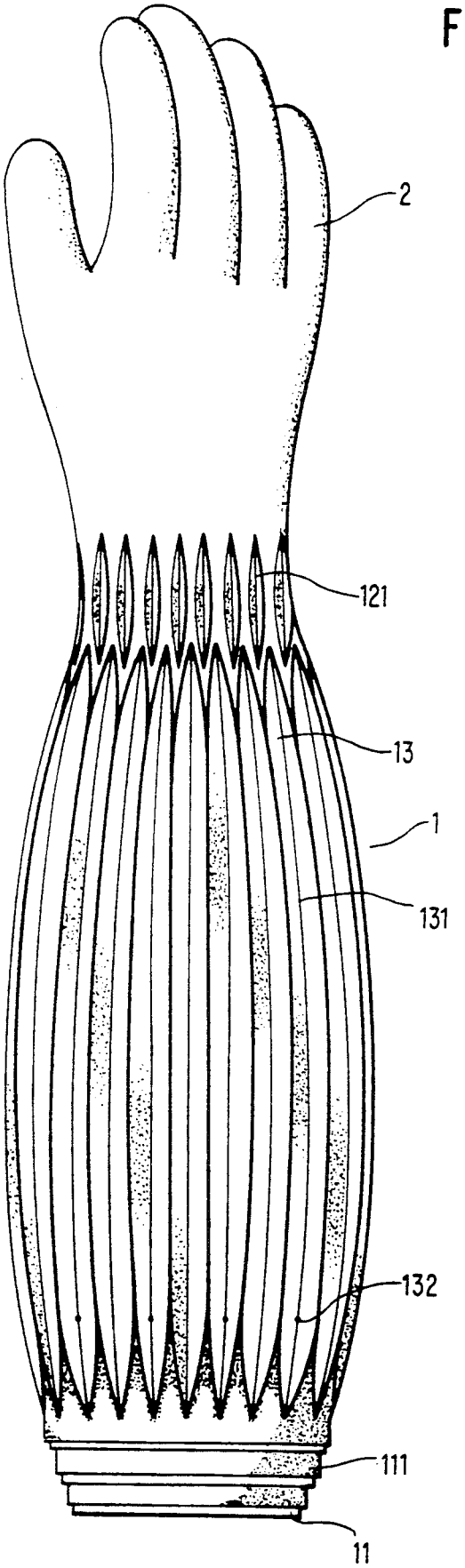
FIG. 3 is a plan view of the limb covering according to the present invention in combination with a glove.
Figure 4:
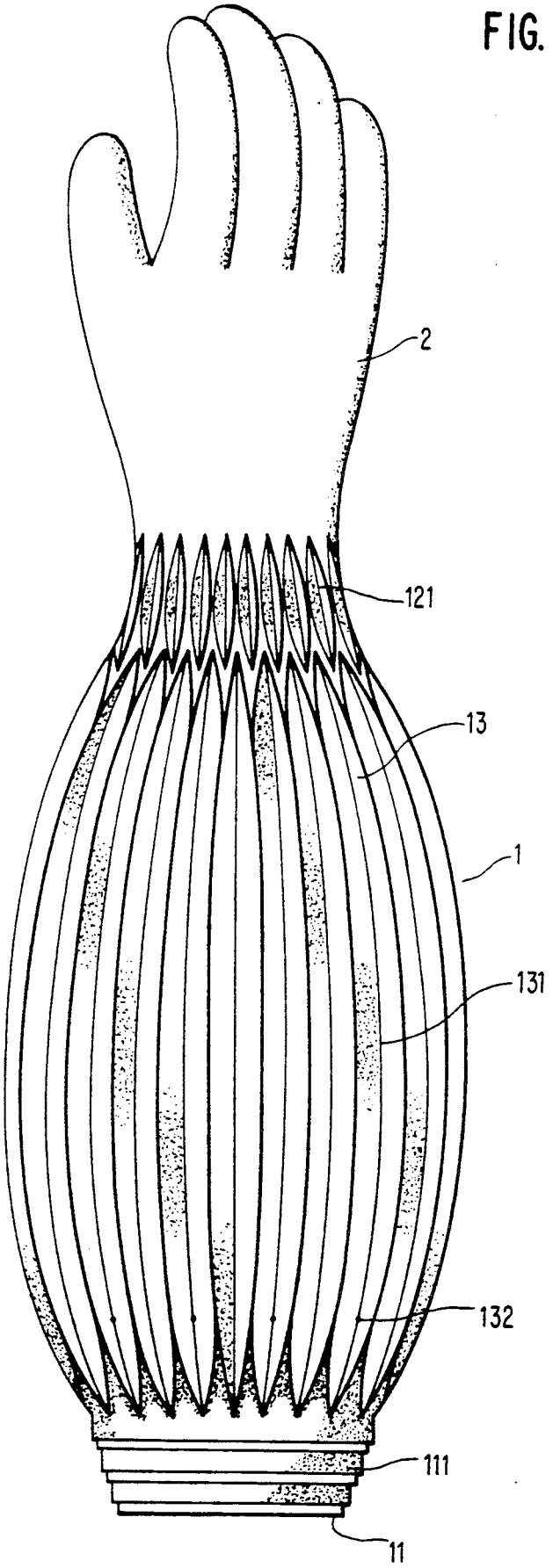
FIG. 4 is a plan view of the limb covering shown in FIG. 3 with the folds in a substantially expanded condition.

As shown in FIG. 3, a short glove 2 can be joined to the elastic band 121 of the main covering body 13 by a one piece forming process using the same material so that the whole limb covering 1 becomes a single long glove for household, industrial and medical use to protect clothing from pollution, to prevent injury to the human body from chemical or other substances, to isolate people from contact with germs and viruses and to provide waterproofing and chill protection. For people wearing bulky clothing, the whole limb covering 1 of the glove and limb combination can be readily expanded as shown in FIG. 4 so that the user can still work very nimbly, comfortably, conveniently and effectively.

Figure 5:
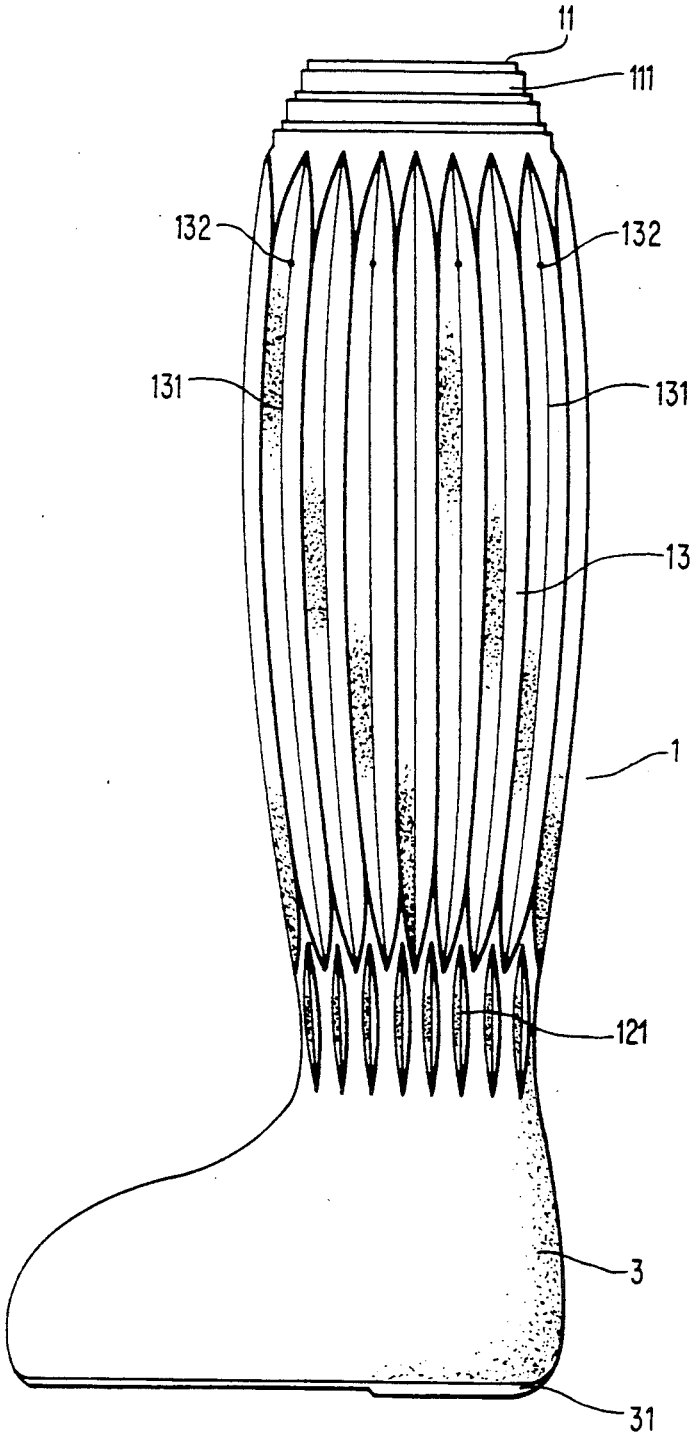
FIG. 5 is a plan view of the limb covering according to the present invention in combination with galoshes.
Figure 6:
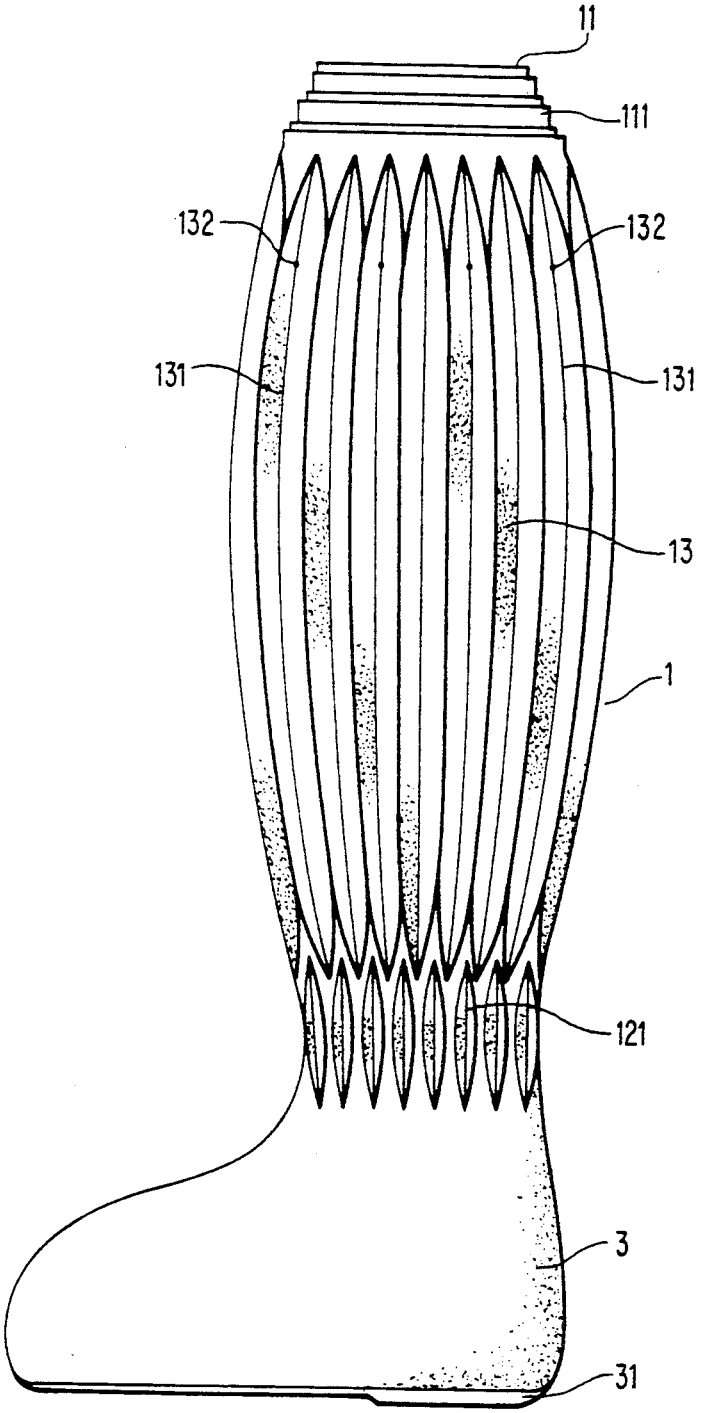
FIG. 6 is a plan view of the limb covering as shown in FIG. 5 with the folds substantially expanded.

As shown in FIG. 5, a shoe or boot portion 3 is connected to the elastic band 121 of the main covering body 13 by a one piece forming process using the same material so that the whole limb covering 1 becomes an elongated galosh. In the manufacturing process, the shoe or boot envelope portion 3 should be provided with sufficient thickness to ensure its endurance for long periods of walking. The elastic binder 111 will securely fix the upper end of the elongated galoshes adjacent the user's knees and the elastic bands 121 will firmly grip the leg at the ankle portion. Thus, it is possible to easily move in mud with no need to worry about the slipping of the galoshes. For heavily dressed users of the elongated galoshes, the elastic and oval-shaped covering body 13 having overall longitudinal folds as shown in FIG. 6, will accommodate the leg and clothing while still permitting nimble and efficient movement.

While the invention has been particularly shown and described with reference to preferred embodiments thereof, it will be understood by those in the art that the foregoing and other changes in form and details may be made therein without departing from the spirit and scope of the invention.

I claim:

1. A limb covering comprising:

a main covering body of tubular elastic material having a plurality of longitudinal folds extending substantially the entire length of said body and disposed about the entire circumference thereof;

an elastic binder at one end of said main covering body having a plurality of adjacent step-like portions each having a different radius with the radius of each portion decreasing toward said one end; and an elastic band at an opposite end of said main covering body of the same elastic material as said main covering body with said main covering body, said elastic band and said elastic binder being formed as one continuous piece.

2. A limb covering as set forth in claim 1, further comprising a glove portion of the same material as said main covering body joined to said elastic band in a continuous unitary one piece construction.

3. A limb covering as set forth in claim 1, further comprising a shoe portion of the same elastic material as said main covering portion joined to said elastic band in a continuous unitary one piece construction.

4. A limb covering as set forth in claim 1, wherein said folds are provided with tapered pointed end portions adjacent opposite ends of said covering whereby the folds can freely expand to provide an enlarged tubular portion intermediate opposite end portions.

* * * * *